United States Patent [19]

Giordano

[11] 4,018,156

[45] Apr. 19, 1977

[54] DOCUMENT IMPRINTER

[75] Inventor: Benjamin B. Giordano, Tenafly, N.J.

[73] Assignee: Litton Business Systems, Inc., Belleville, N.J.

[22] Filed: Nov. 11, 1974

[21] Appl. No.: 522,958

[52] U.S. Cl. ..... 101/106; 101/349

[51] Int. Cl.[2] ..... B41F 31/00

[58] Field of Search ..... 101/348–358, 101/216, DIG. 10, 103, 106; 15/392

[56] References Cited

UNITED STATES PATENTS

| | | | |
|---|---|---|---|
| 1,371,714 | 3/1921 | Warner | 101/DIG. 10 |
| 2,176,769 | 10/1939 | Martinet | 15/392 X |
| 2,192,397 | 3/1940 | Carlson | 15/392 X |
| 2,672,093 | 3/1954 | Meyer et al. | 101/350 |
| 3,455,238 | 7/1969 | Gazbella | 101/349 X |
| 3,730,080 | 5/1973 | Deligt | 101/216 X |

*Primary Examiner*—Edward M. Coven
*Attorney, Agent, or Firm*—Norman Friedman; Robert F. Rotella; Stephen A. Roen

[57] ABSTRACT

A document imprinter, especially for labels, tickets, tags, and the like, having a rotary printing unit and an inking roller, with novel means for adjusting the position of the inking roller relative to the printing unit, said adjusting means including locating means in the form of a plurality of flat surfaces each located at a different distance from the roller's axis of rotation.

3 Claims, 13 Drawing Figures

FIG. 10
FIG. 3
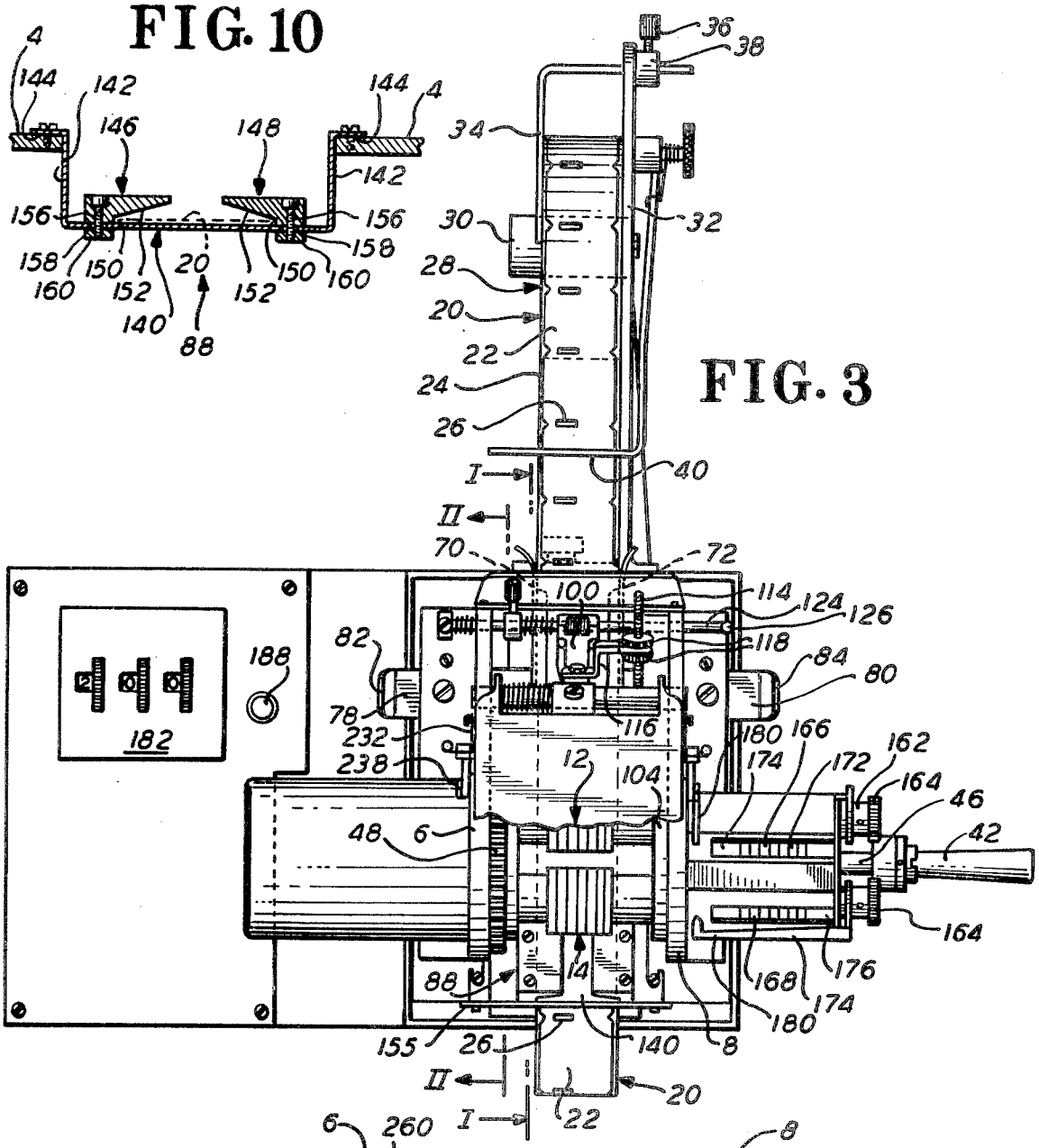
FIG. 4
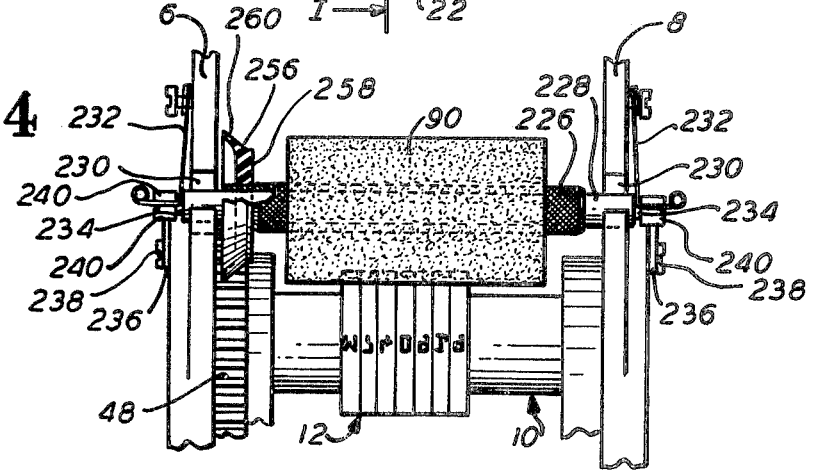

1 2 3 4 5 6 7 8 9 0
A C D M N P R U X Y
. / P £

DOCUMENT IMPRINTER

CROSS-REFERENCE TO RELATED APPLICATIONS

This application is related to the following applications filed on the same date as, and having the same assignee as, the present case: Ser. Nos. 522,953, 522,954, 522,955, 522,956, 522,957.

BACKGROUND OF THE INVENTION

1. Field of the Invention

This invention relates to document imprinters, especially for ticket tags, labels and the like, and more particularly to adjusting the position of the inking roller of such an imprinter.

2. Description of the Prior Art

As the imprinter is used, the inking roller shrinks because of wear, and/or ink depletion if the roller is of the type made of microporous material impregnated with ink.

As such shrinkage occurs, the roller must be adjusted closer to the printing unit to maintain good quality printing. If the roller is adjusted to be too close to the printing unit, the latter will be overinked and smeared printing will result. If the roller is adjusted to be too far away from the printing unit, the result will be faint printing. Such defects are objectionable in the case of conventional visually readable printing, but they cannot be tolerated where the imprinter is printing OCR characters, i.e., characters which are visually readable and also automatically readable by optical character recognition equipment. The foregoing defects will result in reading errors.

One prior art form of such adjusting means for the inking roller comprises a pair of spaced eccentric cams against which the round inking roller shaft rests. The roller adjustment is made by rotating the cams so that a smaller radius thereof engages the roller shaft. Such adjustment is difficult for the user of the machine to make. For example, when the cam screws are retightened after the adjustment has been made, the retightening tends to rotate the cams away from their adjusted position. Furthermore, precisely the same adjustment must be made on both cams, which is difficult to do.

SUMMARY OF THE INVENTION

In accordance with the present invention, there is provided a novel, easy to operate adjusting means which, if desired, can be used in conjunction with the foregoing prior art spiral cams. The novel adjusting means comprises flat surfaces provided at the opposed ends of the inking roller shaft. Each of such surfaces is located at successively smaller distances from the longitudinal axis of rotation of the roller. To adjust the roller, all that need be done is rotate the shaft to position the next flat surface portion thereof against the supporting reference surface. The latter may, if desired, be the prior art adjustment cams. These are fixed once at the factory and need not thereafter be changed.

It is therefore a primary object of the present invention to provide a novel adjustment means for a roller of a document imprinter.

It is the further object to provide such an adjustment means for the inking roller of a document imprinter.

It is the further object to provide adjustment means for a roller of a document imprinter in which the adjustment means comprises flat surfaces located at different distances from the axis of rotation of the roller.

The above and other objects, advantages, and features of the invention will become apparent to those skilled in the art from the following detailed description of a specific embodiment of the invention when read in conjunction with the accompanying drawings, in which:

BRIEF DESCRIPTION OF THE DRAWINGS

FIG. 3 is a top plan view of the machine.

FIG. 4 is a fragmentary, top plan, detail view partially in section showing the inking roller drive mechanism.

FIG. 10 is a sectional view of the label web discharge chute, taken on line X — X of FIG. 2.

DETAILED DESCRIPTION OF A SPECIFIC EMBODIMENT

Figure 1:
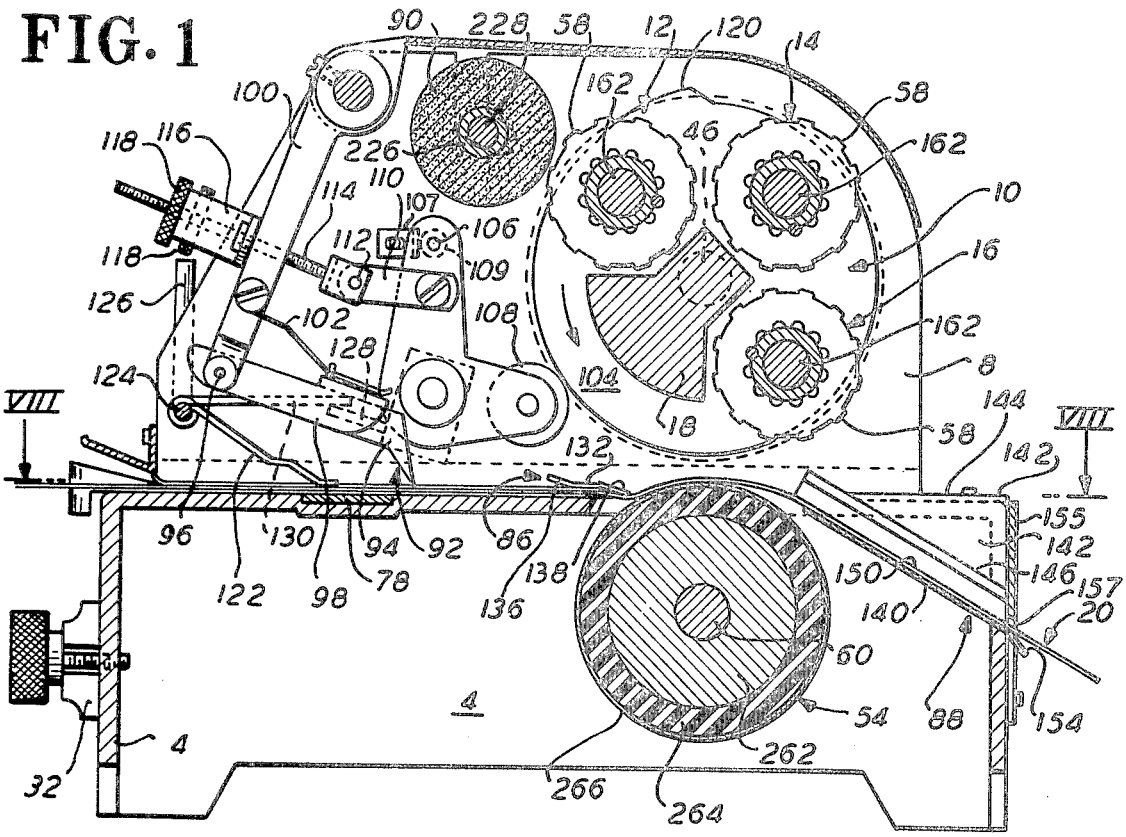
FIG. 1 is a left side elevational sectional view of the upper portion of the imprinting machine, taken on line I — I of FIG. 3.
Figures 5, 6, 7, 13:
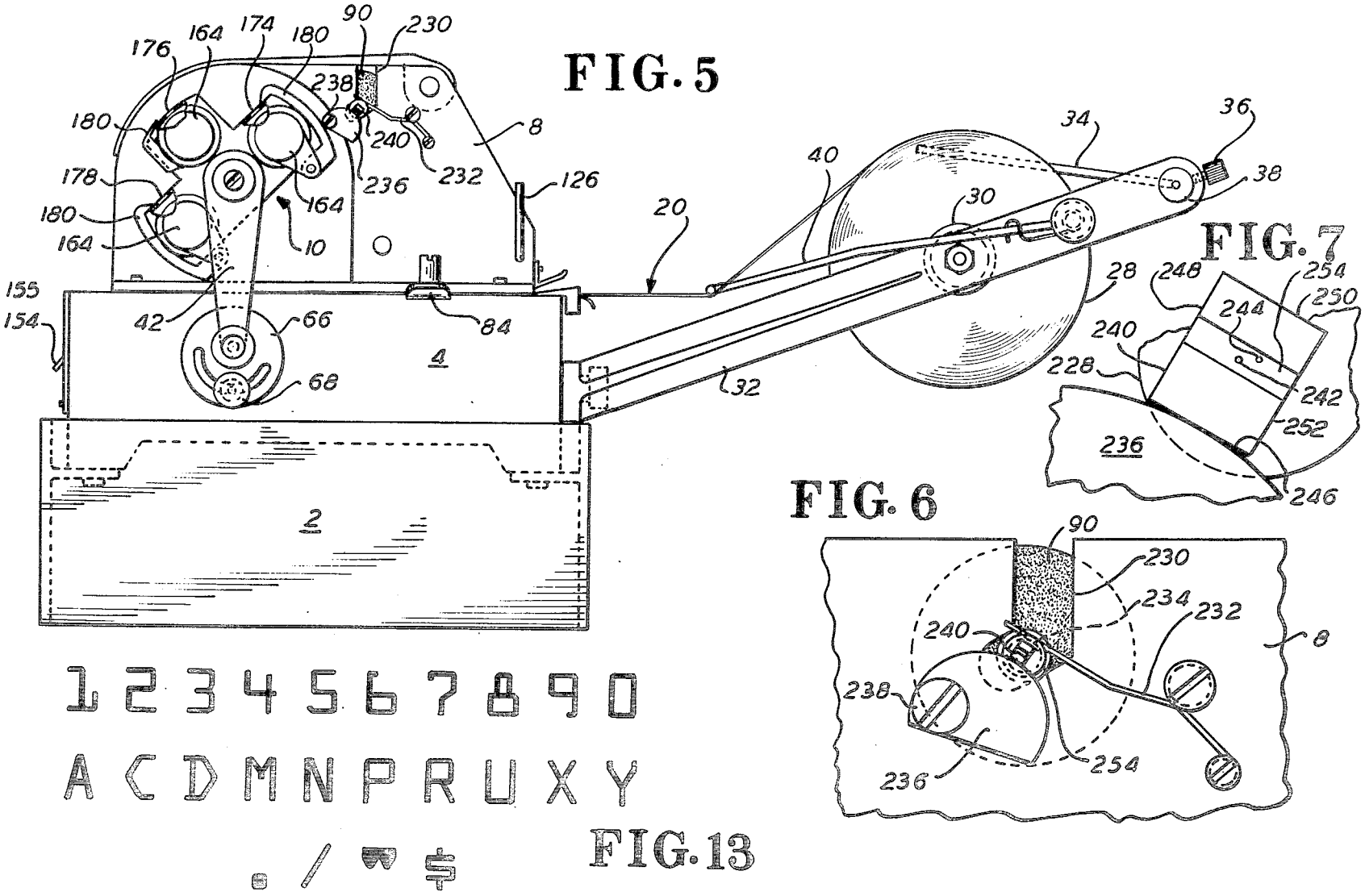
FIG. 5 is a right side elevational view of the machine.
FIG. 6 is an enlarged, fragmentary, detail, right side elevational view of the inking roller adjustment mechanism.
FIG. 7 is an enlarged detail of FIG. 6.
FIG. 13 shows a typical set of printed OCR characters.

The present label imprinting machine includes a main base 2 (FIGS. 2, 5) on which is secured an overlying secondary base member 4 (FIG. 1). Mounted on the latter is a pair of upstanding, spaced plates 6 and 8. Journaled for rotation in opposed large circular openings of plates 6 and 8 is the rotary printing unit 10 of the machine. It includes a number, in the present example three, banks of printing wheels 12, 14, and 16 disposed at different angular locations about the axis of rotation of the printing unit. Each printing wheel is provided with a set of type faces for printing digits and, in addition, any other desired characters and symbols. The type faces may be configured to print conventional characters which are readable only visually. Alternatively, the type faces may be specially configured to print visually readable characters which are also automatically readable by optical hand-held means or other automatic character reading equipment. Such characters are customarily called OCR characters. One typical font of and standards for the printing of such OCR characters is set forth in the "American National Standard Character Set and Print Quality for Optical Character Recognition (OCR-A)" published by the American National Standards Institute. FIG. 13 shows a typical set of such characters.

The rotary printing unit also carries a chase holder 18 on which is adapted to be mounted a snap-in chase for printing fixed information.

Each printing wheel is adapted to be rotatably set or adjusted for selection of any of of its type faces for printing, by mechanism which will be described later.

The rotary printing unit 10 prints on a web of label material 20 (FIGS. 1, 3, 5, 8). The latter comprises an upper strip 22 (FIG. 3) of label stock, coated on its underside with a pressure sensitive adhesive by which it is adhered to an underlying carrier or liner strip 24. The label web 20 is provided with perforations 26 separating adjacent label portions from each other, and by which the label web is fed through the imprinter.

A supply roll 28 of the label web 20 is supported on a lateral extending shaft 30 carried by a rearwardly extending arm 32 secured to base member 4. A forwardly extending rod 34 holds roll 28 against leftward movement. To insert a new supply roll, set screw 36 mounted in the supporting hub 38 for rod 34 is loosened to permit the latter to be swung upwardly. A rod 40 (FIGS. 3, 5) pivoted at its rear on arm 32 is spring biased downwardly against label web 20 as limited by arm 32. This makes a tensioned extra length of web quickly available in response to high acceleration downstream feeding movement of the web.

The rotary printing unit 10 is operated by being rotated counterclockwise, as viewed from the left side of the machine (FIG. 1). It is driven either by a hand crank 42 or an electric motor 44. The hand crank is mounted on the end of a rightwardly extending shaft 46 fast with the rotary printing unit. The crank and shaft are coupled together by any suitable unidirectional drive coupling whereby the crank will be effective to drive the printing unit in its intended direction (e.g., counterclockwise in FIG. 1) but not in the opposite direction.

A gear 48 (FIG. 2) of printing unit 10 is meshed with a cooperating gear 50 fast on a hollow shaft 52 on which is secured the resilient, cylindrical, rotatably driven platen 54 (FIG. 1) of the machine.

When the imprinter is driven by electric motor 44 power is transmitted from the motor output pinion 56 to the platen gear 50 which in turn drives the printing unit gear 48. Because of the aforedescribed unidirectional coupling between hand crank 42 and shaft 46 of printing unit 10, the crank will not be driven by shaft 46, but will remain stationary.

For each printing wheel, the selected type face for printing will be that face which is radially outermost relative to the central axis of rotation of the entire rotary printing unit 10. In FIG. 1 these selected printing type faces are designated by the reference numeral 58. These all lie on a common imaginary cylindrical surface. The platen is so spaced from this cylindrical surface as to provide a printing nip slightly less than the thickness of the label web 20. The height of this nip is adjustable by changing the vertical position of the platen hollow shaft 52. The latter is journaled for its rotary movement on a stationary shaft 60. The opposed ends of shaft 60 are provided with eccentric coaxial trunnions 62, 64 (FIG. 8) supporting the shaft for rotary adjustment. Because of the eccentricity of hubs 62, 64, manual rotation of an adjusting wheel 66 (FIG. 5) fast with shaft 60 will vary the vertical position of platen 54. Wheel 66 is frictionally locked in any adjusted position by an abutting shoulder of a set screw 68 cooperable therewith.

The label web 20 runs from the supply roll 28 to a pair of opposed spaced lateral web guides 70, 72 (FIG. 8), each having an inwardly extending overhanging flange 74, 76 to prevent upward movement of the label web. Respective lateral extension pieces 78 and 80 of the guides are closedly slidably received in upwardly opening grooves of base member 4. Upwardly bent outer end portions 82, 84 of the guides are manually graspable to adjust the lateral position and spacing of the guides.

A short distance before it enters the printing nip, the label web 20 passes beneath a laterally extending guide plate 86 mounted on the forward end of flange 76 of the right hand web guide 72. After leaving the printing nip, the label web travels to a discharge chute 88 whence it exits the machine. The structure and function of plate 86 and discharge chute 88 will be described in detail later.

Printing is effected on three separate lines of each label portion of web 20 from printing wheel banks 12, 14, and 16 successively. The printing wheels are inked by swinging past and making contact with an inking roller 90. The latter may be of any suitable microporous, highly absorbent hard or relatively yieldable material impregnated with ink, e.g., Porelon.

The normal angular position of printing unit 10 is such that the first bank of wheels 12 has not yet swung into inking contact with roller 90 and the last bank 16 of wheels has printed and moved past the printing nip. See for example FIG. 1. In each cycle of rotation of printing unit 10, the selected type faces of each printing wheel bank will first be inked by contacting inking roller 90, and will then rotate to the printing nip to print on label web 20.

At the printing nip, the selected printing type faces in cooperation with platen roller 54 will engage the label web with a squeezing rolling action to print on and also feed the web a short step of movement to position the current label portion to receive the next line of printing from the second bank 14 of printing wheels. In like fashion, the second and third wheel banks 14 and 16 will be inked and will then respectively print on and simultaneously line space that same label portion.

The longitudinal distance that the printing performed by each printing wheel bank is effective to feed the label web is adjusted by changing the printing nip pressure. This will control the extent that the elastomeric yieldable platen roller 54 wraps around the printing type faces at the nip, and therefore the angular distance through which the type faces will be in feeding engagement with the label web. The foregoing adjustment is made by the previously described manually turnable wheel 66 which rotates the eccentric end trunnions 62, 64 supporting platen roller 54 to vary the vertical position of the roller.

The aforedescribed feeding of the label web three steps of movement by the three printing wheel banks does not feed the label strip one full label length. To accurately feed the label web the remaining step of movement to position the next label portion for imprinting, there is provided a feed finger means 92 (FIG. 1) engageable with the leading edge of each feed perforation 26 of the web. The feed finger means comprises a number of thin, side-by-side identical feed finger members 94 pivoted at their rear ends on a pin 96 and housed within a downwardly opening channel member 98 also pivoted on said pin. Pin 96 is carried at the lower end of a link 100 pivotally supported at its upper end. Link 100 is normally spring biased rearwardly, thereby normally maintaining the feed members 94 likewise in rearmost position. Spring 102 carried by link 100 biasses channel member 98, and therefore also feed members 94, downwardly. In each cycle of rotation of printing unit 10, link 100 and therefore feed members 94 will be driven forward. In this movement the feed members will drop into the web feed perforation 26 and will drive the web forward to position it to receive printing on its next blank label portion.

The foregoing cyclic movement of link 100 is controlled by a cam plate 104 fast with rotary printing unit 10. A bell crank 106 is limited in its counterclockwise movement (FIG. 1) by a stop lug 107 engaged by a stop portion 109 of the bell crank, whereby a roller 108 of the latter is held a short distance from the circular periphery of plate 104. Bell crank 106 is coupled in driving relation with link 100 by a member 110 pivoted at 112 to a threaded rod 114. The latter extends through the right hand portion of an offset member 116 fastened at its left end to link 100 (see also FIG. 3). Nuts 118 threaded on rod 114 on either side of offset member 116 couple the two together. At the beginning of the cycle, after the first printing wheel bank 12 has been inked by inking roller 90 but before that bank is effective to print, a cam portion 120 of plate 104 will rock bell crank 106 clockwise which, through the aforedescribed linkage, will drive the feed finger members 94 forward to feed the web its final step of movement. The amount by which the feed members 94 feed the web is adjustable by rotating nuts 118 to vary the amount of threaded rod between offset member 116 and the right hand end of the rod. This adjusts the clockwise, home position of link 100 and therefore the rearmost or home position of feed members 94, and consequently the latters' forwardmost feeding position.

The machine includes a rear, web hold-down arm 122 fast on a rotatable shaft 124 spring biased clockwise as viewed in FIG. 1. To facilitate threading the label web 20 into the machine, an upward extension 126 of shaft 124 is manually pulled to the rear to raise arm 122. In the course of the latter's upward movement, it engages the feed finger means 92 to also raise it out of the way.

To avoid tearing the label web when it is being fed by feed finger means 92, during this feeding movement hold-down arm 122 is lifted off the web by a rearwardly extending pin 128 of bell crank 106 engaging and lifting an arm 130 fast with shaft 124 to rock the shaft counter-clockwise.

Label Web Constraining Means

The label web strip as commercially supplied often has a longitudinal curl. This curl, and random vertical movement of the web upstream and downstream of the printing nip, will cause ink smears on the labels as a result of the web brushing against the printing wheels. Also, if the label web in the printing nip area has slack in it or any of the foregoing curl, the printed characters will not be absolutely sharp but rather will be blurred. If the printed label web leaving the machine encounters any obstacle blocking its forward movement, the web may also tend to buckle upwardly into unintended contact with the printing wheels which would also cause ink smears.

If the label imprinter is to be used for conventional, non-OCR printing, the foregoing defects are not usually functionally critical, although they do result in imprinted labels which present a sloppy appearance. Some label users will find such labels unacceptable. However, if the labels are being imprinted with OCR characters for automatic reading, the foregoing defects cannot be tolerated. They will result in reading errors.

Figure 8:
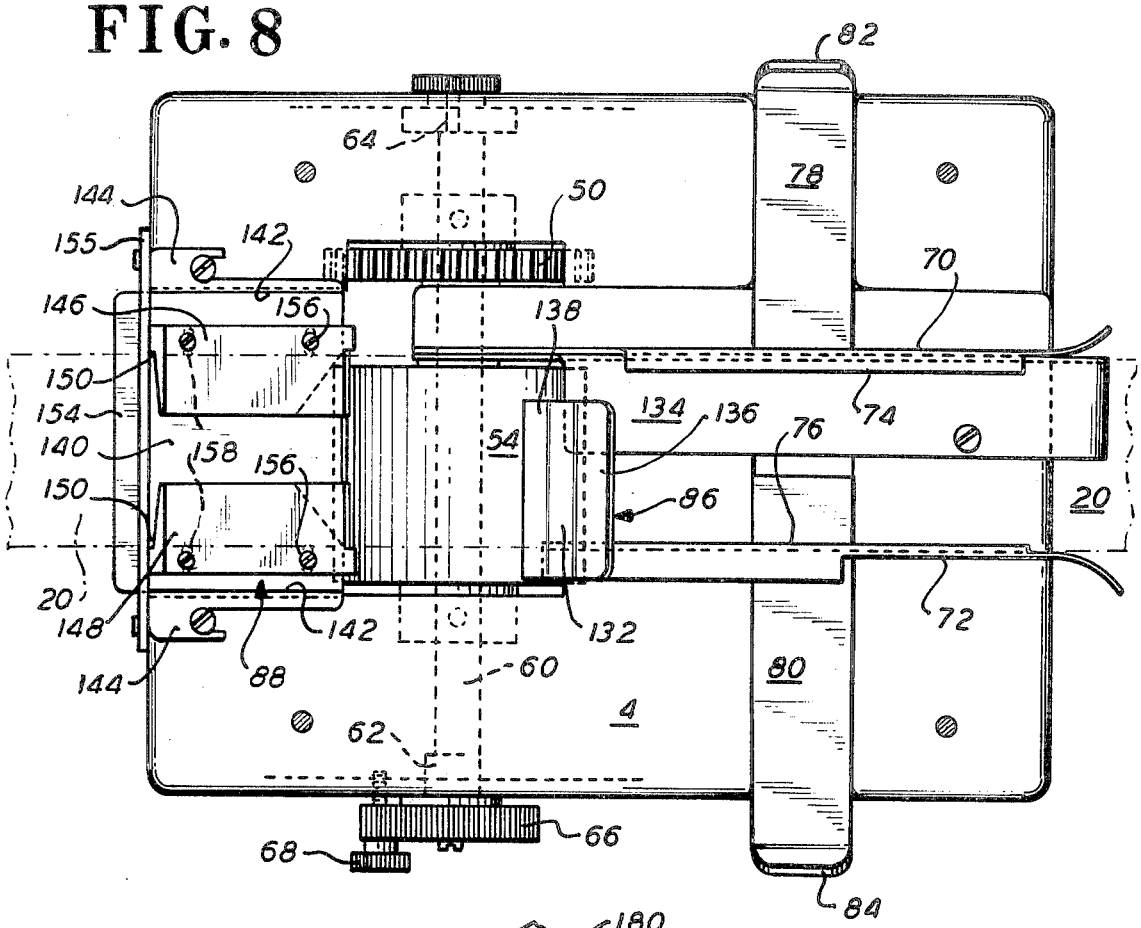
FIG. 8 is a top plan view of the lower portion of the machine, taken on line VIII — VIII of FIG. 1.

The foregoing problems are avoided in the present machine by the provision of the aforementioned web hold-down plate 86 and discharge chute 88, which serve to constrain the label web against upward movement adjacent the printing nip. Plate 86 is rigidly fastened to the forward end of the right hand web guide member 72, and is positioned a short distance upstream of the printing nip. As best seen in FIG. 8, it extends leftwardly a substantial distance, across nearly the entire width of platen roller 54 and more than three quarters of the web width. Hold-down plate 86 includes a central portion 132, which overlies and is spaced a short distance above the underlying web-supporting surface of base member 4 (including a bed plate 134 of the latter); a rearwardly and upwardly extending portion 136 defining a throat; and a forwardly and downwardly extending portion 138.

The upwardly extending throat portion 136 facilitates threading the forward end of a new label web length beneath the hold-down plate. The downwardly sloping forward portion 138 of the plate terminates along a line lower than the highest, printing nip area of platen 54 (FIG. 1). It therefore holds wrapped around the platen a portion of the label web starting at a point upstream of the printing nip and continuing to at least and a short distance beyond the printing nip.

The imprinted label web 20 leaving the printing nip area shortly thereafter enters the adjacent discharge chute 88 (FIGS. 1, 2, 3, 8, 10), which is disposed in a suitable cut-out provided at the front end of base member 4. The chute includes a thin downwardly sloping base plate 140 having opposed upstanding sides 142 which terminate at their upper ends in slotted lateral flanges 144 by which the plate is screwed to base member 4. Secured to the downwardly sloping base plate 140 is a pair of opposed spaced overlying guide members 146, 148, the latter being of the cross section shown in FIG. 10. They each have a lowermost, inner, subtantially vertical shoulder portion 150, and an overlying inwardly and upwardly sloping wall 152. The side to side distance between opposed inner shoulder surfaces 150 is slightly greater than the width of the label web so as to closely confine the latter for its forward feeding movement. The overlying walls 152 constrain the web against upward movement. Their inward and upward slope insures that they will not be contacted by the web's upper surface, thus avoiding smearing the freshly printed characters and any pick-up of adhesive from the web.

It will be seen that the foregoing hold-down plate 80 upstream of the nip and downwardly sloping discharge chute 88 downstream of the nip will constrain the label web by holding it downwardly away from the printing wheels of rotary printing unit 10 to prevent unintended contact of the strip with the wheels and consequent smearing of the strip. Further, the portion of the label web at and upstream of the printing nip will be held wrapped around the platen roller thereby removing any slack in that portion of the web. This will result in sharper, better quality printing, which is particularly important in OCR printing.

The forwardmost portion 154 of the guide chute's base plate 140 is downwardly bent to stiffen the plate. Fastened to base member 4 is a U-shaped plate 155 having depending legs which straddle base plate 140. The bight portion of plate 155 is formed along its lower edge with a knife edge 157 overlying base plate 140; and along which the discharged web is torn off by the operator.

To accommodate different widths of label web, the means securing the chute guide members 146, 148 to base plate 140 provide for lateral adjustability of the position of each guide member. This securing means comprises headed screws 156 extending through laterally elongated slots 158 in base plate 140 and screwed into retainer plates 160 (see FIG. 10).

Printing Wheel Setting Mechanism

The mechanism whereby the printing wheels of each printing wheel bank 12, 14, 16 are individually rotatably set for selection of the types faces to print is as disclosed in U.S. Pat. No. 3,427,961, to which reference is made for a fuller disclosure of the details of such mechanism. Briefly, it includes for each wheel bank a shaft 162 (FIGS. 1 – 3, 9) having mounted thereon means for coupling it to any selected ordinal one of the wheels corresponding to the various longitudinally shifted positions of the shaft. The shaft is then rotated so as to correspondingly rotatably set any given type face on the wheel to printing position. Each shaft 162 is longitudinally shifted and rotated by a manually graspable knob 164 mounted on its right end.

The printing wheel setting mechanism includes for each of the banks of printing wheels corresponding respective banks 166, 168, 170 of indicator dials 172, for displaying to the operator through longitudinal window slots 174, 176, 178 what is the current setting, i.e., rotated position, of the corresponding printing wheel (see also FIG. 5). Respective order pointers 180 each fast with its related setting shaft 162 points to the ordinal one of the indicator dials 172 corresponding to the printing wheel with which setting shaft 162 is then coupled for rotary adjustment of that wheel.

In the aforementioned U.S. Pat. No. 3,427,961, the window slots of the three respective indicator dial banks are angularly positioned corresponding to the angular displacement of the three printing wheel banks. That is to say, each adjacent pair of windows is about 90° apart; and the two endmost, i.e., the first and third, indicator windows are about 180° apart.

As a result, the operator when viewing the machine from the usual position in front of and somewhat above the machine — at about a 45° or so viewing angle — can effectively read only the middle indicator dial bank 168. Therefore, to set the other two printing wheel banks, she must rock printing unit 10 forward to be able to read the third dial bank 170 and backward to be able to read the first bank 166. This will result in defectively printed labels and label wastage. The forward and rearward rocking will swing the first and second printing wheel banks 12 and 14 back and forth across inking roller 90, resulting in overinking of these wheels. In fact, the forward rocking may rotate the first wheel bank 12 sufficiently far forward to cause an unintended printing by this bank on the label web. Similarly, the rearward rocking may be of sufficient extent to cause an unintended printing by the third wheel bank 16 and possibly even the second wheel bank 14.

Figure 9:
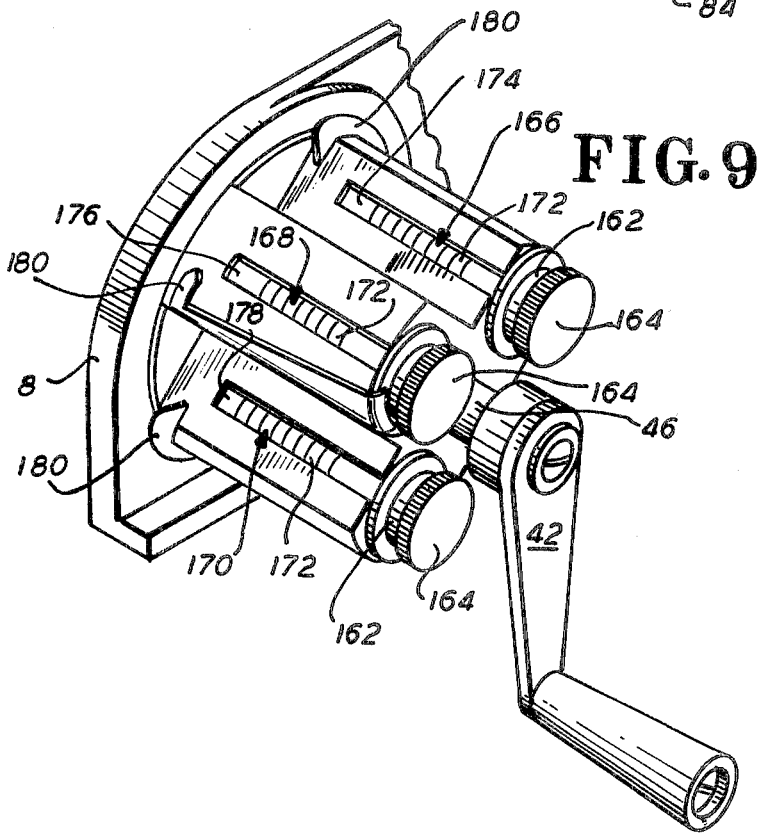
FIG. 9 is a fragmentary right hand perspective view of the printing wheel setting mechanism.

The present machine avoids the foregoing disadvantages by having the dial indicator viewing windows arranged so that all three of them can readily be read by the operator when the rotary printing unit is in its normal home angular position, i.e., with the first wheel bank 12 somewhat upstream of inking roller 90. As best seen in FIGS. 5 and 9, the first and third indicator dial windows 174, 178 are not more than about 120° apart. Furthermore, the windows are so positioned that they are all at about a right angle of the 45° or so usual viewing angle of the operator positioned in front of the machine. The three windows are all essentially parallel to one another and, as shown in FIG. 5, are preferably disposed in two parallel planes. The middle window 176 lies in one plane, and the first and third windows 174, 178 lie in a second, parallel plane closer to the axis of rotation of printing unit 10.

Hence, in the normal position of rotary printing 10, the operator can easily see all three indicator windows in one line of sight, and therefore need not rock the printing unit to change the settings of all three banks of printing wheels.

Full Cycle Stopping Means

The machine includes a conventional manually presettable counter 182 which is counted back one step for each cycle of rotation of printing unit 10. When the counter is counted back to zero, power to motor 44 is cut off thereby terminating operation of the machine.

In the prior art machine of the present type, there is no provision for controlling in what angular position the printing unit will ultimately come to rest. When the motor power is cut off, the printing unit coasts to rest to a random position.

The printing unit may coast to rest in a too far forward position. If sufficiently far forward, this will cause an unintended printing on label web 20 by at least the first printing wheel bank 12. In any event, it may require the operator to manually rock the printing unit backward so that she can see the indicator windows. This will swing at least the first printing wheel bank backward past inking roller 90, thereby compounding the overinking problem discussed in the preceding section of this specification.

Also, the operator may instead rock the printing unit forwardly for resetting the wheels including the first bank. This will cause the latter to first print its previously set data as the third (lowermost) line on the label. The operator then may change the setting of all three banks and resume operation. This will result in the first completely printed label being erroneous. It has the old data on its third line, but the newly set data on its first and second lines.

There may result even further errors in the printed information. Consider a situation where the first printing wheel bank 12 has come to rest a short distance downstream past inking roller 90. If the machine includes the improved indicator window arrangement of the preceding section, the operator can nevertheless easily see all three indicator windows. If she now changes the setting of any wheels of the first printing wheel bank 12, the newly set type faces will fail to print and the unchanged type faces will print too lightly, both because the first wheel bank has previously already swung past the inking roller. In fact, if a long period of time elapses before the machine is used, not even the unchanged type faces will print since the residual ink thereon will have completely dried.

To avoid the foregoing problems, the present machine is provided with a full cycle stopping means in the form of dynamic electric braking circuitry effective to terminate the machine's operation with the rotary printing unit always coming to rest at substantially the same desirable angular position, i.e., with the last printing bank 16 having already printed and the first printing bank 12 upstream of inking roller 90 (FIG. 1). Of course, if desired any suitable mechanical full cycle stopping means can be provided instead.

Figure 11:
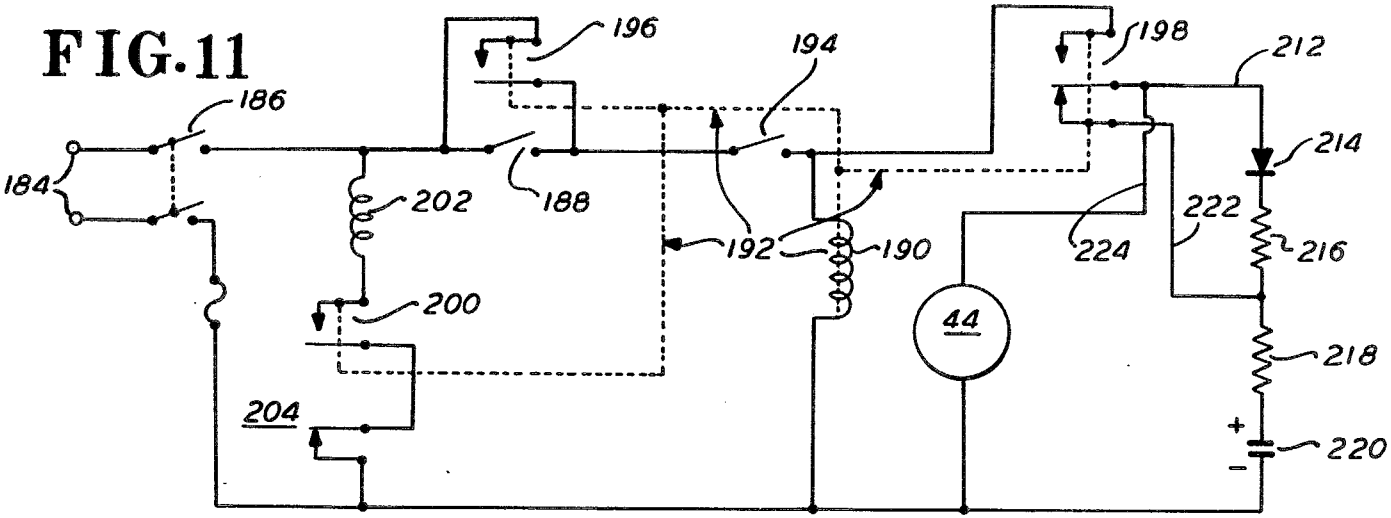
FIG. 11 is a diagram of the motor control circuit, including the full cycle braking circuit.
Figure 12:
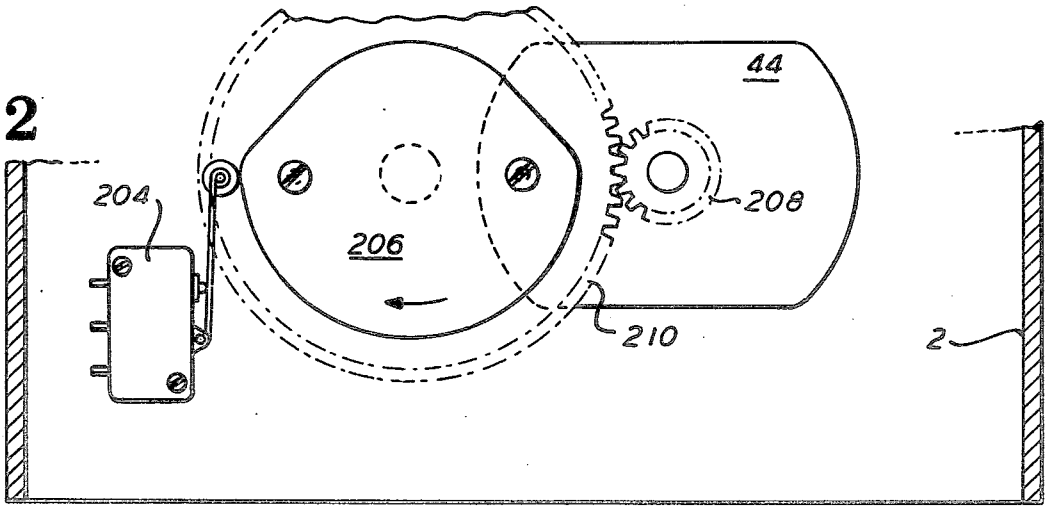
FIG. 12 is a left side elevational view in section of the lower portion of the machine, showing the cam for controlling the full cycle motor braking circuit.

The electric motor circuit including the full cycle dynamic braking circuitry will now be described with particular reference to FIGS. 11 and 12. Electric power is supplied to the machine at 184 under control of the machine's main switch 186. With the latter closed, temporary depression of the machine start switch 188 (see also FIG. 3) will energize the coil 190 of a relay 192 through a conventional off-zero switch 194 of counter 182. Relay 192 has contacts 196, 198, and 200. Switch 194 is at all times closed so long as the counter reads other than zero, and opens when the count returns to zero. Upon energization of relay 192 in response to depression of start switch 188, relay contact 196 will close thereby providing a self latching circuit for the relay; and contact 198 will transfer to its upper position thereby supplying power to the motor, which will drive the rotary printing unit. Energization of relay 192 also closes its contact 200.

Counter 182 includes a customary decrementing coil 202 which when energized counts the counter back by 1. Decrementing coil 202 is energized successively on each cycle of rotation of rotary printing unit 10 by a switch 204 controlled by a cam 206 which is driven from motor 44 through gear train 208, 210 at a one to one ratio with the rotary printing unit.

Switch 204 is a normally closed switch. During the first part of the machine's cycle, the high portion of cam 206 maintains switch 204 open. In the second part of the cycle, the low portion of the cam permits this switch to close, thereby applying power to decrementing coil 202 to count counter 182 back one unit. The foregoing cyclic operations continue so long as the counter needs other than zero.

As soon as the counter has counted back to zero, its off-zero switch 194 will open. Prior to this time, while the motor has been running and relay contact 198 is in its upper transferred position, voltage has been applied to the dynamic braking circuit through line 212. The braking circuit comprises half wave rectifier 214, resistors 216 and 218, and capacitor 220. Capacitor 220 will therefore be in charged condition while the motor is running. The opening of the counter off-zero switch 194 in response to the count returning to zero will de-energize relay coil 190 thereby causing relay contact 198 to transfer back to its normal position of FIG. 11. This will result in the charged capacitor discharging through motor 44 to temporarily impose a retarding or braking force on the motor, and thereby rapidly bringing the motor to rest. The discharging path of capacitor 220 is through resistor 218, line 222, relay contact 198, line 224, and thence through the motor.

Motor 44 may be of any suitable type operable with the aforedescribed braking circuit, e.g., a permanent split capacitor motor. The amount of time required to stop the motor can be varied by suitably changing the component values of the braking circuit to vary the braking discharge current of capacitor 220. The final, angular stopped position of the rotary printing unit can be adjusted by changing the angular position of cam 206 to vary the point in the cycle when the cam low portion allows switch 204 to close. This will control exactly when in the cycle the counter is stepped back to zero, which in turn will determine exactly when the counter off-zero switch 194 opens. As decribed above, it is this opening of switch 194 which initiates operation of the motor braking circuit.

Inking Roller Adjustment Means

The machine includes means for accurately and easily adjusting the position of inking roller 90 relative to the rotary printing unit 10. Such adjustment, which involves the roller being held at successively closer distances to the printing wheels, is needed to compensate for shrinkage of the roller caused by wear and/or ink depletion. It is important that such adjustment be precise. If the roller is too close to the printing wheels, too much ink will be deposited on the wheels, which will result in smeared printing. If it is too far away, there will be insufficient inking resulting in too-light printing. In either case, for OCR characters it will result in erroneous automatic reading; and for conventional characters in unattractive labels. Further, the adjustment should be such that it is easily made by the user.

Inking roller 90 (FIGS. 1, 4, 5) is pressed on a hollow sleeve 226 which is rotatably journaled on a shaft 228. The latter's opposite ends are disposed in the lowermost downwardly and forwardly sloping portions of guide slots 230 provided in the opposed spaced upstanding plates 6 and 8. Respective springs 232 mounted on the plates are seated in annular slots 234 of shaft 228 and firmly urge the latter forwardly and downwardly against the respective adjustable eccentric segment cams 236.

In the prior art machine, the shaft end portions abutting cams 236 are round. The position of the inking roller (i.e., its shaft 228) is adjusted by loosening the screws 238 on which the cms are rotatably mounted, and then rotating the cams. This adjustment is difficult to make accurately. The retightening of screws 238 has a tendency to cause further rotation of the cams away from the desired adjusted setting. Also, the adjustment must be done separately for each end of the shaft, but it is difficult to achieve precisely the same adjustment at each end.

In the present machine, the rotated position of the cams 236 is set once, at the factory. The opposed ends 240 of the inking roller shaft instead of being round where they contact the spiral cams are instead flat so as to have a polygonal cross section, which may be rectangular, as best seen in FIG. 7. The center 242 of this rectangle is eccentric in both a length and width sense relative to the central longitudinal axis 244 of shaft 228, which is the axis of rotation of the inking roller. The amount of this eccentricity in both the rectangle's length and width dimension is so selected that when shaft 228 is supported on the cams 236 the different ones of the four successive adjacent rectangular flat portions, the shaft's central longitudinal axis 244 — and therefore the inking roller 90 relative to printing unit 10 — will be in the four corresponding successive radially adjusted positions. Thus, when the machine is new, roller shaft 228 will be set so that its rectangular flat 246 which spaces the shaft's central longitudinal axis 244 the furthest from cams 236 will rest on the latter. Thereafter, as the roller wears, necessitating moving the roller closer to rotary printing unit 10, shaft 228 is adjusted by being turned 90° to bring the next closer flat 248 into engagement with cams 236 thereby adjusting inking roller 90 one step closer to the printing unit. In like fashion, as it further shrinks, the roller is similarly adjusted the third and fourth steps closer to the printing unit by positioning the third and fourth flats 250, 252 of the shaft against the spiral cams.

To facilitate the foregoing rotary adjustment of the inking roller, a screwdriver slot 254 may be provided in either or both of its ends.

The initial rotary positioning of the cams 236 need only be done once at the factory. Thereafter, all subsequent adjustments of the radial position of the inking roller is done as described above by merely rotating shaft 228 to position the desired one of its end flats against the cams 236.

While a rectangular cross-section has been disclosed, it will be understood that any suitable polygonal shape can be used. The important consideration is that the distance from the central longitudinal axis 244 of shaft 228 to each flat of the polygon is slightly different by the amount of each desired adjustment.

Inking Roller Drive Means

To achieve the best quality of printing, and especially for OCR printing, it is desirable that inking roller 90 be rotatably driven and with zero relative velocity between the roller and the print wheel at the inking nip line. Otherwise, any relative movement between the roller and the type faces will cause excessive ink to be applied to the latter which will result in smeared, overinked, non-sharp printing.

Furthermore, the rotational ratio of the printing unit and inking roller to achieve zero velocity at the inking nip should desirably be maintained at all times. However, as described in the preceding section of this specification, the axis of rotation of the inking roller is from time to time adjusted by bring it closer to the printing unit 10.

Figure 2:
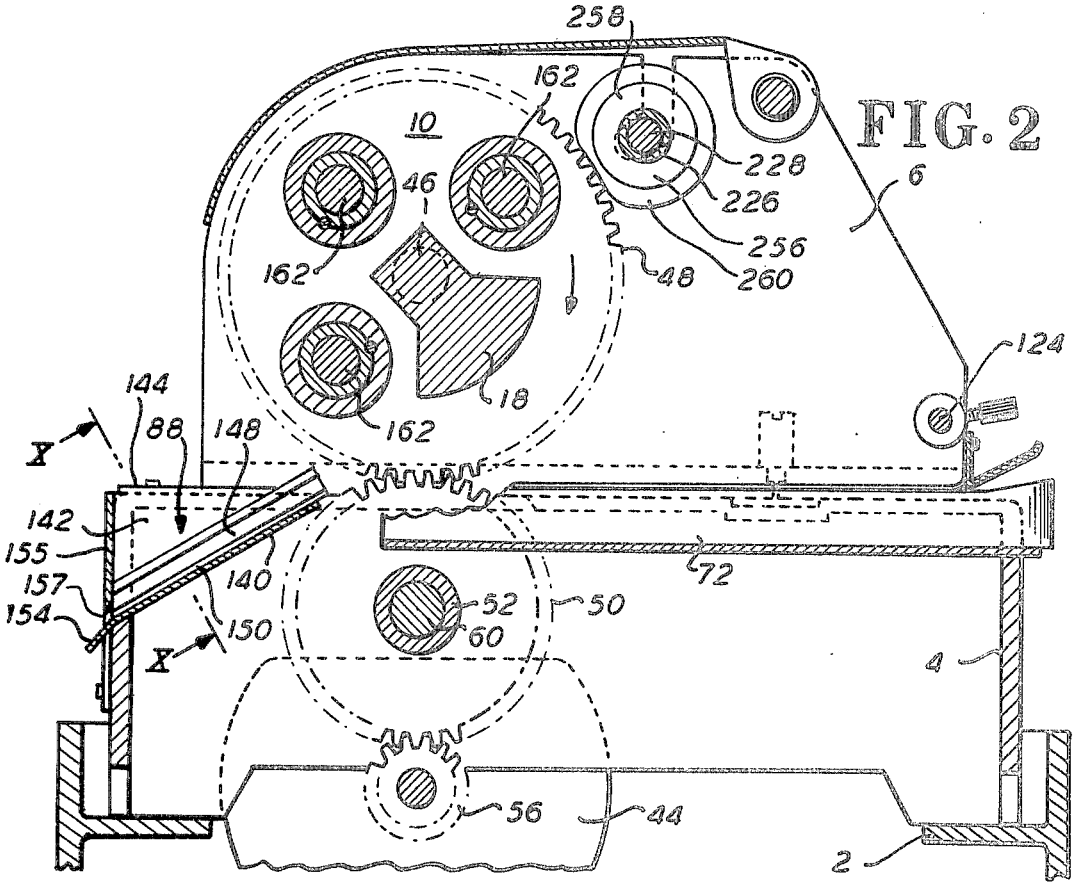
FIG. 2 is a right side elevational sectional view of the machine, taken on line II — II of FIG. 3.

The following novel, simple, and inexpensive drive arrangement is provided in the present machine to keep the rotation ratio constant irrespective of the adjustment changes in the center to center distance of the inking roller and the printing unit. As best seen in FIGS. 2 and 4, mounted fast on a leftward extension of sleeve 226 on which inking roller 90 is mounted, is a cup-shaped drive member 256 for inking roller 90. Member 256 is made of rather soft yieldable rubber or other elastomeric material, and comprises a base 258 and a thin walled annular flange or wall portion 260 opening to the left. Because of the elastomeric nature of the material of which drive member 256 is made, and further because of its thin walled annular fange 260, the latter portion is particularly readily deformable. The cup-shaped member is rotatably driven by the aforedescribed gear 48 of rotary printing unit 10. For this purpose, the cup-shaped member is of such diameter that its annular wall 260 will be substantially deformed inwardly by the gear teeth so that the wall wraps around a portion of gear 48. The rotational ratio of rotary printing unit 10 and inking roller 90 will be determined by the ratios of the outer circumferences of the deformed cup wall and gear 48. It will not depend on the radial position of the cup member because the latter is of quite yieldable material. Therefore, irrespective of the degree of flattening or squashing of cup member 256, a given amount of rotation of gear 48 will always cause the same corresponding amount of rotation of the cup member. The teeth of the gear will always engage and drive the same circumferential length of the member, regardless of how much of the latter is wrapped around the gear. The amount of such wrap-around will be changed by the aforedescribed adjustment of the inking roller. Thus, even though the inking roller is adjusted by being moved closer to the rotary printing unit, the ratio of rotation of the two will remain unchanged.

The use of the readily deformable cup-shaped drive member 256 offers a further advantage. When inking roller 90 is adjusted inwardly, the substantial yieldability of member 256 avoids any possibility that the rearwardly directed resisting force of member 256 will overcome the forwardly directed force of springs 232 and thereby unseat the inking roller shaft 228 from spiral cams 236.

The cup annular wall 260 need not necessarily normally be outwardly sloping as shown in FIG. 4. It can if desired be of cylindrical form, i.e., parallel to shaft 228.

Platen Roller

Platen roller 54 (FIG. 1) comprises a core 262 of metal, such as steel or aluminum, supporting a surrounding annulus 264 of rubber or other elastomeric platen material. In prior art machines, the outermost surface of the rubber annulus 264 is exposed. In the present machine, however, the platen roller is provided with a thin outermost sleeve 266. The latter is of a material that is relatively smooth and glossy and to which the pressure sensitive adhesive of the label web will not readily adhere. The sleeve material although yieldable is preferably harder and firmer than the underlying rubber platen annulus 264. One suitable sleeve material having the foregoing characteristics is Teflon (a brand of tetrafluoroethylene fluorocarbon resin) about 0.025 – 0.030 inches thick, heat shrunk over rubber annulus 264.

The provision of the foregoing external sleeve offers a number of advantages. There may be a tendency of the pressure sensitive adhesive of the label web to bleed laterally into the feed holes 26 and from there be deposited onto platen roller 54. Sleeve 266, being smooth, glossy, and non-adherent to the adhesive, minimizes and retards the amount of such adhesive build-up on the platen roller.

Further, the fact that sleeve 266 is harder than the underlying rubber annulus 264 will result in sharper printing quality, which is particularly important for OCR printing. In one example, the Shore A Durometer hardness readings of the sleeve and rubber anulus are 97 and 78 respectively. The better definition in printing quality occurs because there is less wrapping of the platen around the printing type faces when they engage at the printing nip. That is to say, the greater firmness of the sleeve as compared with the underlying rubber annulus results in less deformation of the outermost surface of the platen roller in response to its pressure engagement by the printing type faces, through the label web.

It will of course be understood that the various principles and features of the invention, as defined in the following claims, are susceptible of numerous modifications and of applications in many contexts and environments other than the specific machine disclosed herein. Accordingly, it should further be understood that the foregoing disclosure of a specific embodiment of the invention and in a particular machine, is intended to be illustrative and exemplary only and in no way limitative of the following claims. As just one example, the invention can be used in imprinting machines which print optical bar codes instead of or in addition to conventional OCR characters.

I claim:

1. In a document imprinter having a frame on which are mounted: printing means for printing information on documents, said printing means comprising a rotary printing unit including type faces to be inked to print said information on said documents; an inking roller mounted for rotation about a longitudinal axis of rotation and cooperable with said rotary printing unit to ink said type faces; axis-defining means defining said longitudinal axis of rotation of said inking roller, said axis-defining means being movably adjustable in a direction transverse to said longitudinal axis; means for adjusting in said transverse direction the position of said axis-defining means, and therefore of said longitudinal axis of rotation and said inking roller; said adjusting means comprising:

a plurality of individual, discrete locating surfaces each corresponding to a different transversely shifted position of said axis-defining means;

said locating surfaces defining in cross section a rectangle;

said axis of rotation of said inking roller intersecting said rectangle at a point which is eccentric relative to the center of said rectangle;

a reference surface means;

any selected one of said locating surfaces being selectively engageable with said reference surface means, each of said locating surfaces when engaged with said reference surface means being effective to cause said axis-defining means, and therefore said longitudinal axis of rotation and said inking roller, to be held in a different transversely shifted position, each such shifted position corresponding to a different one of said locating surfaces.

2. In a document imprinter having a frame on which are mounted: printing means for printing information on documents, said printing means comprising a rotary printing unit including type faces adapted to be inked to print said information on said documents; an inking roller mounted for rotation about a longitudinal axis of rotation and cooperable with said rotary printing unit to ink said type faces; axis-defining means defining said longitudinal axis of rotation of said inking roller, said axis-defining means being movably adjustable in a direction transverse to said longidudinal axis; means for adjusting in said transverse direction the position of said axis-defining means, and therefore of said longitudinal axis of rotation and said inking roller; said adjusting means comprising:

a plurality of individual, discrete locating surfaces each corresponding to a different transversely shifted position of said axis-defining means;

a shaft on which said inking roller is mounted, said shaft having two opposed end portions;

said locating surfaces being provided at different circumferential positions about, on, and fast with said shaft, said locating surfaces further being provided at both opposed end portions of said shaft;

a reference surface means;

said shaft being rotatably mounted on said frame, for selective positioning of any selected one of said locating surfaces on and fast with said shaft against said reference surface means, any selected one of said locating surfaces thereby being selectively engageable with said reference surface means, each of said locating surfaces when engaged with said reference surface means being effective to cause said axis-defining means, and therefore said longitudinal axis of rotation and said inking roller, to be held in a different transversely shifted position, each such position corresponding to a different one of said locating surfaces.

3. The combination according to claim 2, wherein:

said inking roller is rotatable relative to said shaft;

said shaft defining said longitudinal axis of rotation of said inking roller.

* * * * *

UNITED STATES PATENT AND TRADEMARK OFFICE

CERTIFICATE OF CORRECTION

PATENT NO. : 4,018,156

DATED : April 19, 1977

INVENTOR(S) : Benjamin B. Giordano

It is certified that error appears in the above-identified patent and that said Letters Patent are hereby corrected as shown below:

Column 2, line 59, OCR should be set off in quotes --"OCR"--.

Column 8, line 4, after "angle" change "of" to --to--.

Column 9, line 25, 1 should be set off in quotes --"1"--;

line 37, "needs" should be --reads--.

Column 10, line 33, "cms" should be --cams--.

Column 11, line 33, "by" should be --to--.

Signed and Sealed this second Day of August 1977

[SEAL]

*Attest:*

RUTH C. MASON
*Attesting Officer*

C. MARSHALL DANN
*Commissioner of Patents and Trademarks*